US005577394A

United States Patent [19]

Rathbone

[11] Patent Number: 5,577,394

[45] Date of Patent: Nov. 26, 1996

[54] AIR SEPARATION

[75] Inventor: Thomas Rathbone, Surrey, England

[73] Assignee: The BOC Group plc, Surrey, England

[21] Appl. No.: 504,871

[22] Filed: Jul. 20, 1995

[30] Foreign Application Priority Data

Jul. 25, 1994 [GB] United Kingdom ..... 9414939

[51] Int. Cl.[6] ..... F25J 3/00

[52] U.S. Cl. ..... 62/653; 62/924

[58] Field of Search ..... 62/653, 924

[56] References Cited

U.S. PATENT DOCUMENTS

| | | | |
|---|---|---|---|
| 4,533,375 | 8/1985 | Erickson | 62/22 |
| 4,575,388 | 3/1986 | Okada | 62/924 |
| 4,702,757 | 10/1987 | Kleinberg | 62/24 |
| 4,883,516 | 11/1989 | Layland et al. | 62/924 |
| 5,305,611 | 4/1994 | Howard | 62/642 |

FOREIGN PATENT DOCUMENTS 0450768 9/1991 European Pat. Off. .

*Primary Examiner*—Ronald C. Capossela

*Attorney, Agent, or Firm*—David M. Rosenblum; Larry R. Cassett

[57] ABSTRACT

Cooled and purified air is introduced into a higher pressure rectifier in at least partly vaporous state and is separated therein into oxygen-enriched liquid air and nitrogen. One part of the nitrogen so separated is condensed in a reboiler-condenser and another part in a reboiler-condenser. Some of the condensate is used as reflux in the high pressure rectifier, and the rest of the condensate as reflux in a lower pressure rectifier. Oxygen-enriched liquid air is taken from the bottom of the higher pressure rectifier and is separated into oxygen and nitrogen in the lower pressure rectifier. A liquid argon-enriched oxygen stream is withdrawn from the lower pressure rectifier through an outlet and is separated into argon and oxygen fractions in a further rectifier. The further rectifier is reboiled by the reboiler-condenser.

18 Claims, 3 Drawing Sheets

AIR SEPARATION

BACKGROUND OF THE INVENTION

This invention relates to a method and apparatus for separating air.

The most important method commercially of separating air is by rectification. The most frequently used air separation cycles include the steps of compressing a stream of air, purifying the resulting stream of compressed air by removing water vapor and carbon dioxide, and pre-cooling the stream of compressed air by heat exchange with returning product streams to a temperature suitable for its rectification. The rectification is performed in a so-called "double rectification column" comprising a higher pressure and a lower pressure rectification column i.e. one of the two columns operates at higher pressure than the other. Most if not all of the air is introduced into the higher pressure column and is separated into oxygen-enriched liquid air and liquid nitrogen vapor. The nitrogen vapor is condensed. A part of the condensate is used as liquid reflux in the higher pressure column. Oxygen-enriched liquid is withdrawn from the bottom of the higher pressure column, is sub-cooled, and is introduced into an intermediate region of the lower pressure column through a throttling or pressure reduction valve. The oxygen-enriched liquid is separated into substantially pure oxygen and nitrogen products in the lower pressure column. These products are withdrawn in the vapor state from the lower pressure column and form the returning streams against which the incoming air stream is heat exchanged. Liquid reflux for the lower pressure column is provided by taking the remainder of the condensate from the higher pressure column, sub-cooling it, and passing it into the top of the lower pressure column through a throttling or pressure reduction valve.

Conventionally, liquid oxygen at the bottom of the lower pressure column is used to meet the condensation duty at the top of the higher pressure column. Accordingly, nitrogen vapor from the top of higher pressure column is heat exchanged with liquid oxygen in the bottom of the lower pressure column. Sufficient liquid oxygen is able to be evaporated thereby to meet the requirements of the lower pressure column for reboil and to enable a good yield of pure gaseous oxygen product to be achieved.

An alternative to this conventional process is to use a part of the feed air to provide the necessary heat to reboil liquid in a first reboiler-condenser at the bottom of the low pressure column. This alternative removes the link between the top of the higher pressure column and the bottom of the lower pressure column. Accordingly, the operating pressure ratio between the two columns can be reduced, thus reducing the energy requirements of the air separation process. Nitrogen separated in the higher pressure column is condensed in a second reboiler-condenser by heat exchange with liquid withdrawn from an intermediate mass-exchange region of the lower pressure rectification column. This alternative kind of process is referred to as a "dual reboiler" process.

One disadvantage of dual reboiler processes is a difficulty in obtaining an argon product by rectification of an argon-enriched oxygen stream withdrawn from the lower pressure rectification column. In order to produce such an argon product effectively, it is desirable to operate the bottom section of the lower pressure rectification column at a relatively high reboil rate so as to achieve conditions therein close to minimum reflux. To achieve such a high reboil rate, air would need to be condensed in the first reboiler-condenser at a relatively high rate with an attendant high rate of condensation of the air. Introduction of such liquid air into the higher pressure column reduces the rate of formation of liquid nitrogen reflux available to the lower pressure column. As a result, attempts to achieve an adequate argon recovery by increasing the reboil rate beyond a certain limit would become self-defeating.

It is an aim of the present invention to provide a method and apparatus that ameliorate this problem.

SUMMARY OF THE INVENTION

According to the present invention there is provided a method of separating argon from air comprising the steps of introducing a flow of compressed and cooled feed air in at least partly vapor state into a higher pressure rectifier and separating the flow into oxygen-enriched liquid air and nitrogen; condensing nitrogen so separated and employing one part of the condensate as reflux in the higher pressure rectifier and another part of it as reflux in a lower pressure rectifier; separating in the lower pressure rectifier a stream of oxygen-enriched liquid air derived directly or indirectly from the higher pressure rectifier; reboiling the lower pressure rectifier with a vapor stream of the feed air; withdrawing a stream of argon-enriched liquid oxygen from the lower pressure rectifier and separating it by rectification in a further rectifier to produce an argon product, wherein at least part of the said nitrogen is condensed by being employed to reboil the further rectifier.

The invention also provides apparatus for separating air comprising a higher pressure rectifier for separating compressed and cooled feed air into oxygen-enriched liquid air and nitrogen; one or more condensers for condensing nitrogen so separated so as to enable in use part of the condensed nitrogen to be employed in the higher pressure rectifier as reflux and another part of it in a lower pressure rectifier also as reflux; means for taking oxygen-enriched liquid air from the higher pressure rectifier and for introducing it directly or via a further separating means into the lower pressure rectifier for separation therein; a reboiler associated with the lower pressure rectifier having condensing passages in communication with a source of compressed and cooled feed air in vapor state; and a further rectifier for producing an argon product having an inlet for an argon-enriched liquid oxygen stream communicating with an outlet from the lower pressure rectifier, wherein the said condenser or one of the said condensers acts as a reboiler for the further rectifier.

By the term "rectifier" as used herein is meant a fractionation or rectification column in which, in use, an ascending vapor phase is contacted with a descending liquid phase, or a plurality of such columns operating at generally the same pressure as one another.

References herein to "reboiling" a rectifier mean that a liquid feed or liquid taken out of mass exchange relationship with ascending vapor in a rectifier is boiled at least in part so as to create an upward flow of vapor through the rectifier. The boiling is typically performed by indirect heat exchange with condensing vapor in a condenser-reboiler. The condenser-reboiler may be located within or outside the rectifier. If the liquid is taken from an intermediate mass exchange region of a rectifier, the reboiling may be said to be performed in an "intermediate" reboiler.

The reboiling of the further rectifier in which the argon product is separated has the consequence of reducing the amount of air that needs to be condensed in reboiling the lower pressure rectifier (in comparison with similar processes in which the feed to the further rectifier is taken from the lower pressure rectifier in vapor state and therefore no reboiling of the further rectifier takes place). Accordingly, a greater proportion of the oxygen product of the method and apparatus according to the invention may be of a relatively high purity (i.e. above 99% by volume of oxygen) and a greater yield or recovery of argon can be achieved.

Preferably, the argon-enriched liquid oxygen feed to the further rectifier is reduced in pressure typically by being passed through a throttling valve upstream of its introduction into the further rectifier.

Preferably, the further column employs random or structured packing to effect liquid-vapor contact therein. A low pressure drop packing (e.g. that sold under the trade mark MELLAPAK) is preferably employed. By a low pressure drop packing is meant one that has a pressure drop of less than 2 millibars per theoretical stage. By reducing the pressure of the feed to the further rectifier and by employing a low pressure drop packing in the further rectifier, it is possible to widen the temperature difference between the bottom and the top of the further rectifier, thereby making possible an enhancement of argon recovery.

Preferably, liquid-vapor contact devices are employed below as well as above the level at which the argon-enriched liquid feed is introduced into the further rectifier.

Preferably, a liquid stream is withdrawn from the bottom of the further rectifier as an oxygen product. The purity of this oxygen product depends on the amount of separation of oxygen from the argon that takes place in the further rectifier below the level at which the argon-enriched liquid feed is introduced.

Although the lower pressure rectifier may be fed with oxygen-enriched liquid air "directly" from the higher pressure rectifier, that is to say the oxygen-enriched liquid air is not changed in composition upstream of its introduction into the lower pressure column, even though it is typically sub-cooled, and reduced in pressure and even though a part of it is typically employed to condense argon separated in the further rectification column, it is preferred to introduce the oxygen-enriched liquid stream into an intermediate pressure rectifier in which nitrogen-enriched vapor is separated therefrom, and to employ a liquid stream further enriched in oxygen as a feed to the lower pressure rectifier. Operation of the intermediate pressure rectifier enhances the rate at which liquid nitrogen reflux may be supplied to the higher and lower pressure rectifiers and thereby makes possible a further enhancement in the proportion of the argon in the incoming air that can be recovered and further increase in the proportion of the oxygen product that can be produced at a purity greater than 99% by volume.

Another stream of liquid air further enriched in oxygen is preferably taken from the bottom of the intermediate pressure rectifier column, is reduced in pressure, and is employed to condense nitrogen-enriched vapor separated in the intermediate pressure rectifier. The condensation is preferably performed in a condenser-reboiler with resulting reboiled further-enriched liquid being introduced into the lower pressure rectifier as feed. Preferably a part of the condensed nitrogen-enriched vapor is employed as reflux in the intermediate pressure rectifier and another part of the condensed nitrogen-enriched vapor is preferably nitrogen of essentially the same purity as that separated in the higher pressure rectifier. If desired, a yet further part of the condensed nitrogen-enriched vapor may be taken as a nitrogen product.

A part of the stream of liquid air further enriched in oxygen which is fed to the lower pressure rectifier from the intermediate pressure rectifier is preferably employed to condense argon separated in the further rectifier, and a part of the resulting argon condensate is returned to the further rectifier as reflux, another part preferably being taken as product. (Alternatively, argon product can be taken in the vapor state.)

Preferably, in addition to its being reboiled by the said stream of the feed air, the lower pressure rectifier is also reboiled at an intermediate level thereof. In some examples of the method and apparatus according to the invention this intermediate reboiling is performed by nitrogen vapor separated in the higher pressure rectifier, the nitrogen thereby being condensed. In such examples, nitrogen separated the higher pressure rectifier is also used to reboil the intermediate pressure rectifier, this nitrogen also being condensed. Accordingly in such examples there are several different sources of liquid nitrogen reflux and as a result well in excess of 40% of the argon in the air fed to the method can be recovered as product and well in excess of 30% of the oxygen product can be produced at a purity of 99.5%. Typically, however, it is not possible in such examples to produce all the oxygen product at a purity of 99.5%: it is necessary to take some of the oxygen product at a lower purity.

In other examples of the method and apparatus according to the invention in which the lower pressure rectifier is reboiled at an intermediate level in addition to its being reboiled by the stream of the feed air, a vapor stream is withdrawn from an intermediate region of the further rectifier and is employed to perform the intermediate reboiling of the lower pressure rectifier. (The vapor stream withdrawn from the further rectifier preferably has a composition that is close to equilibrium with the argon-enriched liquid introduced into the further rectifier as feed.) As a result, at least part of the vapor is condensed. The resulting condensate is preferably returned to the further rectifier. Another vapor stream withdrawn from the same intermediate region of the further rectifier is preferably employed to reboil the intermediate pressure rectifier. As a result, at least part of this vapor is condensed. The resulting condensate together with any uncondensed vapor is preferably returned to the further rectifier. In such examples, it becomes possible to meet the whole of the nitrogen condensation duty of the higher pressure rectifier in effecting the reboiling of the further rectifier. As a result, it becomes possible to separate an oxygen product of at least 99% purity in the further rectifier. Accordingly, all the oxygen product may if desired be produced to a purity of at least 99%. Moreover, an argon recovery of 90% or more is made possible along with an oxygen recovery of 99.5%.

Air is condensed as a result of the reboiling of the lower pressure rectifier. A part or all of the air stream used to reboil the lower pressure rectifier may be so condensed. If all of the air stream is so condensed, there is a separate feed of vaporous air to the higher pressure rectifier. If the air stream is only partly condensed, it may form the flow to the higher pressure rectifier of compressed and cooled feed air. Alternatively, the liquid and vapor phases may be disengaged from one another with the vapor phase sent to the higher pressure rectifier and the liquid phase sent to one or more of the lower pressure rectifier, the higher pressure rectifier, and, if employed, the intermediate pressure rectifier. Similarly, if all the air stream used to reboil the lower pressure rectifier is condensed, it may be distributed to one or more of the aforesaid rectifiers.

BRIEF DESCRIPTION OF THE DRAWINGS

The method and apparatus according to the invention will now be described by way of example with reference to the accompanying drawings, in which.

The drawings are not to scale.

DETAILED DESCRIPTION

Figure 1:
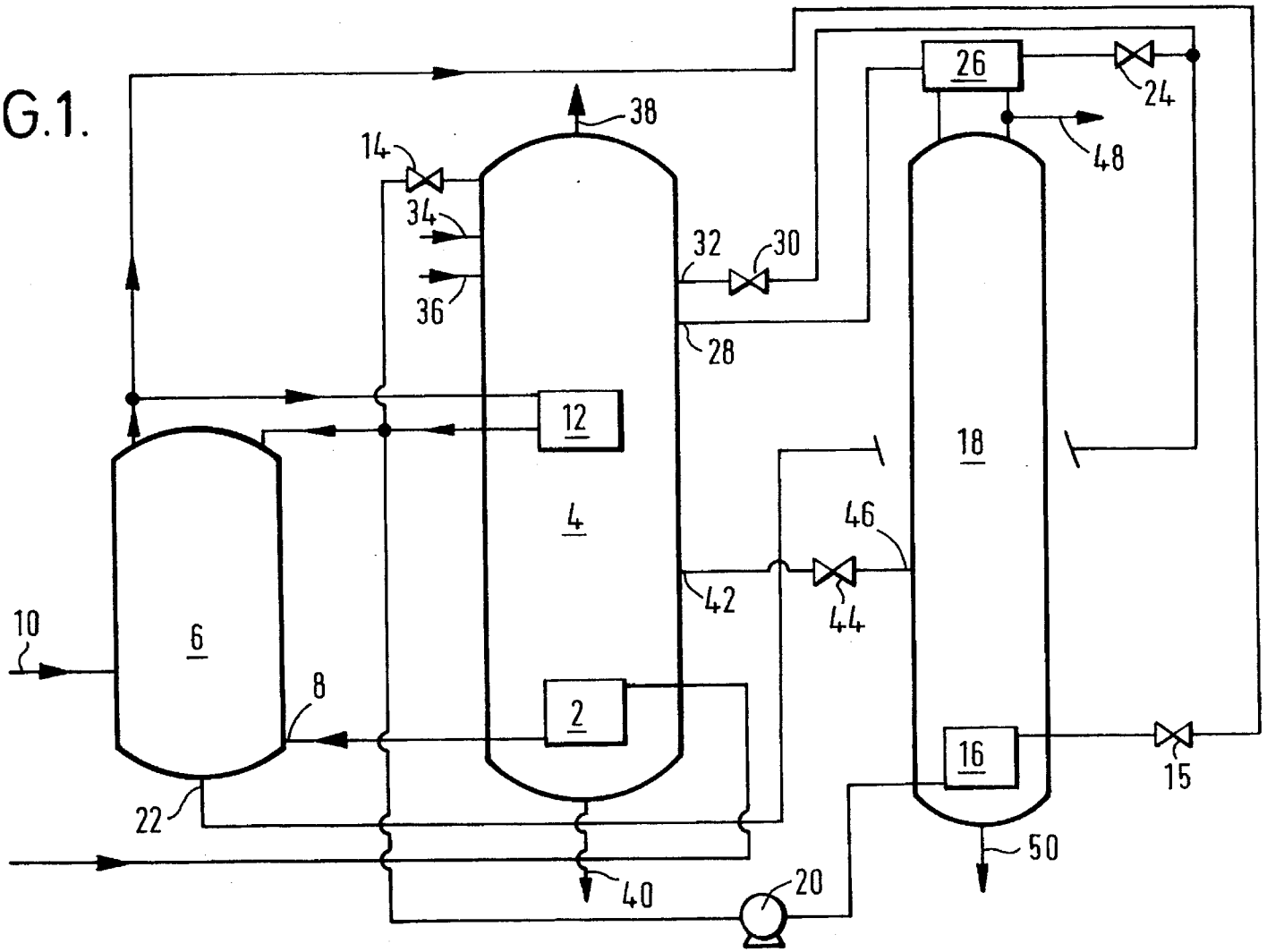
FIG. 1 is a simplified schematic, flow diagram illustrating an arrangement of rectifiers used in performing the method according to the invention.

Referring to FIG. 1 of the drawings, a first stream of compressed vaporous air which has been purified by removal of its components of low volatility, particularly water vapor and carbon dioxide, and cooled to approximately its saturation temperature is partially condensed by passage through the condensing passages (not shown) of a condenser-reboiler 2. The reboiling passages (not shown) of the condenser-reboiler 2 are arranged to provide reboil for a lower pressure rectifier 4 as will be described below.

The partially condensed stream of air flows from the condenser-reboiler 2 into the bottom of a higher pressure rectifier 6 through an inlet 8. The higher pressure rectifier 6 is fed with a second stream of compressed and purified liquid air through an inlet 10. The higher pressure rectifier 6 contains liquid-vapor contact devices (not shown) whereby a descending liquid phase is brought into intimate contact with an ascending vapor phase such that mass transfer between the two phases takes place. The descending liquid phase becomes progressively richer in oxygen and the ascending vapor phase progressively richer in nitrogen. The liquid-vapor contact means may comprise an arrangement of liquid-vapor contact trays or may comprise structured or random packing.

Liquid collects at the bottom of the higher pressure rectifier 6. The inlets 8 and 10 are located such that the liquid so collected is approximately in equilibrium with incoming vaporous air. Accordingly, since oxygen is less volatile than the other main components (nitrogen and argon) of the air, the liquid collecting at the bottom of the rectifier 6 is enriched in oxygen and typically contains in the order of from 30 to 35% by volume of oxygen.

A sufficient number of trays or a sufficient height of packing is included in the higher pressure rectifier 6 for the vapor to be produced at its top to be essentially pure nitrogen. The nitrogen is condensed so as to provide a downward flow of reflux for the higher pressure rectifier 6 and also to provide such reflux for the lower pressure rectifier 4. Condensation of the nitrogen is effected primarily by indirect heat exchange of a stream of it in the condensing passages (not shown) of another condenser-reboiler 12 with boiling liquid in the liquid passages (not shown) thereof. The condenser-reboiler 12 is associated with an intermediate region of the lower pressure rectifier 4 and provides intermediate reboil for this rectifier 4. Thus liquid is withdrawn from an intermediate mass exchange region of the lower pressure rectifier 4 and is reboiled in the boiling passages (not shown) of the condenser-reboiler 12. A part of the condensed nitrogen is returned to the higher pressure rectifier 6 as reflux. Another part is sub-cooled, is passed through a throttling valve 14 and is introduced into the top of the lower pressure rectifier 4 as reflux.

Another stream of nitrogen vapor separated in the higher pressure rectifier 6 is reduced in pressure by passage through a throttling valve 15 and is condensed by indirect heat exchange in the condensing passages (not shown) of another condenser-reboiler 16 which is associated with the bottom of a further rectifier 18 in which argon and impure oxygen products are separated. The resulting nitrogen condensate is returned by a pump 20 to the higher pressure rectifier 6 as liquid nitrogen reflux.

A stream of oxygen-enriched liquid is withdrawn from the bottom of the higher pressure rectifier 6 through an outlet 22, is sub-cooled, and is divided into two subsidiary streams. One of the subsidiary streams is reduced in pressure by passage through a throttling valve 24 to a pressure a little above the operating pressure of the lower pressure rectifier 4. The pressure-reduced stream of oxygen-enriched liquid air is employed in a condenser 26 to condense argon separated in the further rectifier 18. The pressure-reduced stream of oxygen-enriched liquid air is thus vaporized and the resulting vapor stream is introduced as feed into the lower pressure rectifier 4 through an inlet 28 at an intermediate level thereof. The other subsidiary stream of sub-cooled, oxygen-enriched liquid air flows through a throttling valve 30 and is thereby reduced in pressure. Downstream of the throttling valve 30, the other subsidiary stream of sub-cooled, oxygen-enriched liquid air flows into an intermediate region of the lower pressure rectifier 4 through an inlet 32 at a level above that of the inlet 28.

The lower pressure rectifier 4 also receives a feed stream of liquid air through an inlet 34 located above the inlet 32 and a feed stream of vaporous air through an inlet 36 located at the same level as the inlet 32.

The various air streams fed to the lower pressure rectifier 4 are separated therein into oxygen and nitrogen products. In order to effect the separation, liquid-vapor contact devices (not shown), for example distillation trays or random or structured packing, are provided in the rectifier 4 to effect intimate contact between ascending vapor and descending liquid therein, thereby enabling mass transfer to take place between the two phases. The downward flow of liquid is created by the introduction of the liquid nitrogen into the top of the rectifier 4 and by the introduction of the liquid streams into the rectifier 4 through the inlets 32 and 34. The upward flow of vapor is created by operation of the condenser-reboilers 2 and 12 and by the introduction of vapor streams into the lower pressure rectifier 4 through the inlets 28 and 36. An essentially pure vaporous nitrogen product is withdrawn from the low pressure rectifier through an outlet 38. An oxygen product (typically 99.5% pure) is withdrawn in liquid state from the bottom of the rectifier 4 through an outlet 40.

Although air contains only about 0.93% by volume of argon, a peak argon concentration typically in the order of 8% is created at an intermediate region of the lower pressure rectifier 4 below the condenser-reboiler 12. The lower pressure rectifier is thus able to act as a source of argon-enriched oxygen for separation in the further rectifier 18. An argon-enriched liquid oxygen stream typically containing about 5 mole per cent of argon is withdrawn from the lower pressure rectifier 4 through an outlet 42, is reduced in pressure by passage through a throttling valve 44 and is introduced into the further rectifier 18 through an inlet 46. The further rectifier 18 contains a low pressure drop structured or random packing in order to effect intimate liquid-vapor contact and hence mass transfer between a descending liquid phase and an ascending vapor phase. Packing is located in the further rectifier 18 both above and below the level of the inlet 46. The downward flow of liquid through the further rectifier 18 is created by operation of the condenser 26, and is augmented in the bottom region of the rectifier 18 by the liquid feed introduced through the inlet 46. The upward flow of vapor through the further rectifier 18 is created by operation of the condenser-reboiler 16 to reboil liquid at the bottom of the rectifier 18.

A liquid argon product is withdrawn from the condenser 26 through an outlet 48. The purity of the argon product depends on the height of packing in the further rectifier 18 above the level of the inlet 46. If a sufficient height of packing to provide in the order of 180 theoretical plates is employed above the level of the inlet 46, an essentially oxygen-free argon product is produced. Alternatively, however, a substantially smaller height of packing, providing substantially fewer theoretical plates, may be used above the level of the inlet 46. An argon product containing, say, from 0.2 to 2% by volume of oxygen impurity may thereby be produced. Such an argon product may be purified by catalytic reaction with hydrogen, adsorptive removal of water vapor and yet further rectification to remove nitrogen and hydrogen impurities.

An impure oxygen product is withdrawn in liquid state through an outlet 50 from the bottom of the further rectifier 18.

The oxygen products may be produced at elevated pressure by raising the pressure of the products in pumps (not shown) and vaporizing the respective pressurized oxygen streams. Various heat exchangers (not shown) may be employed to effect the cooling and sub-cooling of streams flowing to and from the columns. One or more feed air streams or one or more product nitrogen streams may be expanded with the performance of external work in order to create refrigeration for the method and thereby to maintain a heat balance.

The further rectifier 18 is preferably operated at a pressure in the range of 1 bar to 1.1 bar at its top and the lower pressure rectifier 4 is preferably operated with a pressure in the range of 1.2 to 1.5 bar at its top. Since the bottom of the lower pressure rectifier 4 is not thermally linked by a condenser-reboiler to the top of the higher pressure rectifier 6 (which is the arrangement in a conventional double rectification column for the separation of air) the higher pressure rectifier 6 may be operated at a lower pressure (at its top) than in a conventional double rectification column. Indeed, the higher pressure rectifier 6 is preferably operated at a pressure in the range of 3.75 to 4.5 bar.

The arrangement of rectifiers 4, 6 and 18 shown in FIG. 1 make possible the production of an argon product by virtue of the fact that the operation of the condenser-reboiler 16 enhances the rate at which liquid nitrogen reflux is produced while at the same time reducing the reboil duty on the condenser-reboiler 2 and thus reducing the proportion of the incoming air that needs to be condensed in the condenser-reboiler 2. Nonetheless, the yield of argon that can be achieved and the proportion of the oxygen product that can be produced are still limited by a pinch appearing in the lower pressure rectifier 4 at the inlet 28. This pinch point effectively limits the proportion of the higher pressure rectifier's condensation duty that can be used to provide reboil for the further rectifier 18, and hence limits the argon recovery to approximately 40% of that contained in the feed air.

Figure 2:
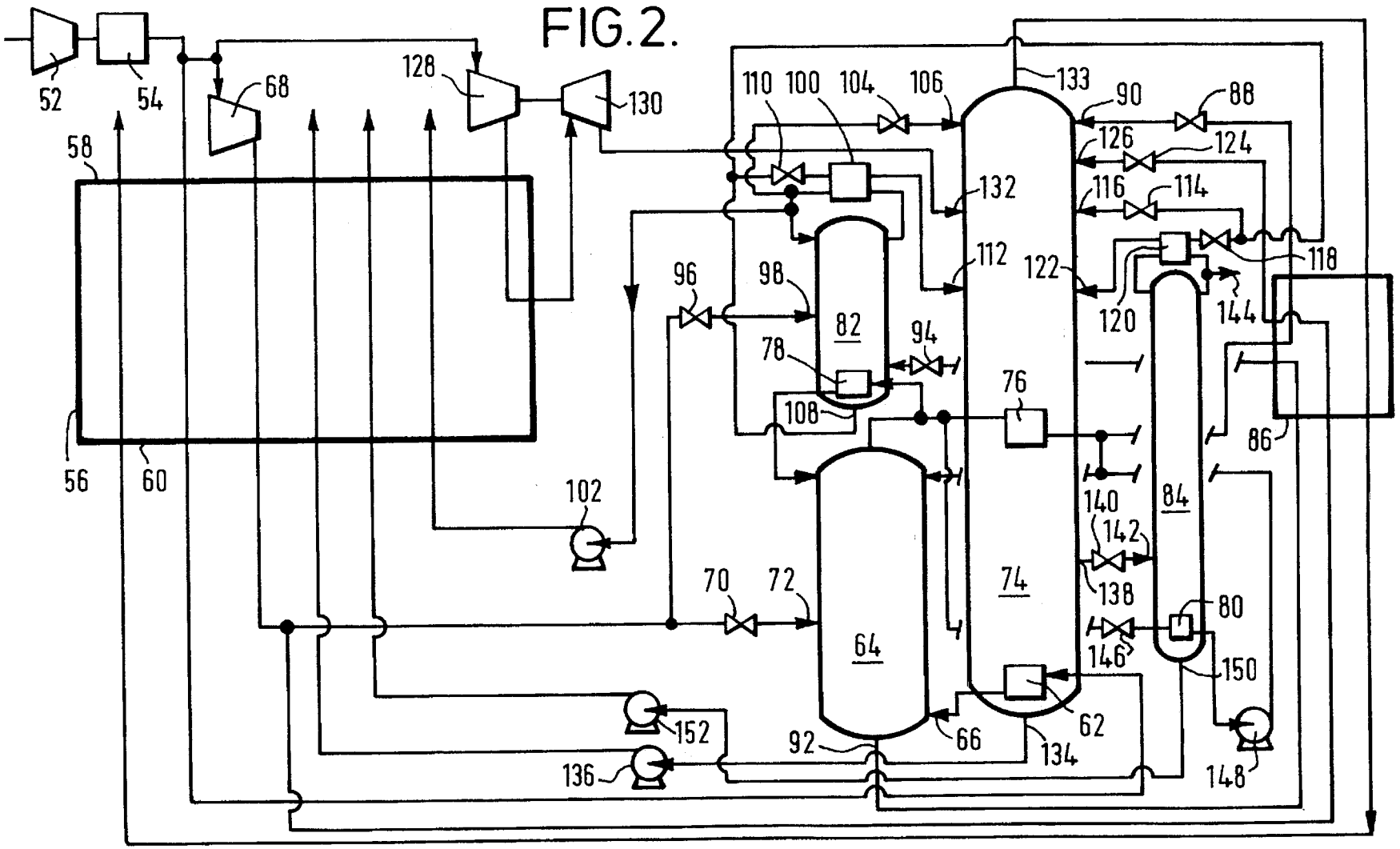
FIG. 2 is a schematic flow diagram of a first air separation plant for performing the method according to the invention.

In FIG. 2 of the accompanying drawings there is shown an air separation plant with an improved arrangement of columns which is able to enhance the rate at which liquid nitrogen reflux is produced and thus increase the argon yield and the proportion of the total oxygen product that can be produced at relatively high purity.

Referring to FIG. 2 of the drawings, a feed air stream is compressed in a compressor 52 and the resulting compressed feed air stream is passed through a purification unit 54 effective to remove water vapor and carbon dioxide therefrom. The unit 54 employs beds (not shown) of adsorbent to effect this removal of water vapor and carbon dioxide. The beds are operated out of sequence with one another such that while one or more beds are purifying the feed air stream, the remainder are being regenerated, for example by being purged with a stream of hot nitrogen. Such a purification unit and its operation are well known in the art and need not be described further.

The purified feed air stream is divided into three subsidiary air streams. A first subsidiary air stream flows through a main heat exchanger 56 from its warm end 58 to its cold end 60 and is thereby cooled from about ambient temperature to just above its saturation temperature (or other temperature suitable for its separation by rectification). The thus cooled air stream flows through a condenser-reboiler 62 and is partially condensed therein. The resulting partially condensed air stream is introduced into a higher pressure fractionation column 64 through an inlet 66. An alternative arrangement (which is not shown) is to divide the first subsidiary air stream downstream of the cold end 60 of the main heat exchanger 56 and introduce one part directly into the higher pressure fractionation column 64 and to condense entirely the other part in the condenser-reboiler 62 upstream of its introduction into the column 64.

In addition to the feed through the inlet 66, the higher pressure fractionation column 64 is also fed with a liquid air stream. To this end, a second subsidiary stream of purified air is further compressed in a compressor 68 and cooled to its saturation temperature by passage through the main heat exchanger 56 from its warm end 58 to its cold end 60. The thus cooled second subsidiary air stream is divided into three parts. One part flows through a throttling valve 70 and is introduced into the higher pressure fractionation column 64 through an inlet 72. The use to which the other parts of the cooled second subsidiary air stream is put will be described below.

The higher pressure fractionation column 64 contains liquid-vapor contact devices (not shown) whereby a descending liquid phase is brought into intimate contact with an ascending vapor phase such that mass transfer between the two phases takes place. The descending liquid phase becomes progressively richer in oxygen and the ascending vapor phase progressively richer in nitrogen. The liquid-vapor contact devices may comprise an arrangement of liquid-vapor contact trays or may comprise structured or random packing.

Liquid collects at the bottom of the higher pressure fractionation column 64. The inlets 66 and 72 are located such that the liquid so collected is approximately in equilibrium with incoming vaporous air. Accordingly, since oxygen is less volatile than the other main components (nitrogen and argon) of the air, the liquid collecting at the bottom of the column 64 is enriched in oxygen and typically contains in the order of from 30 to 35% by volume of oxygen.

A sufficient number of trays or a sufficient height of packing is included in the higher pressure fractionation column 64 for the vapor produced at the top of the column 64 to be essentially pure nitrogen. The nitrogen is condensed so as to provide a downward flow of liquid nitrogen reflux for the column 64 and also to provide such reflux for a lower pressure rectification column 74 with which boiling passages (not shown) of the first condenser-reboiler 62 are associated. Condensation of the nitrogen is effected in three further condenser-reboilers 76, 78 and 80. The boiling passages (not shown) of the condenser-reboiler 76, 78 and 80 are respectively associated with an intermediate mass transfer region of the lower pressure rectification column 74, the bottom of an intermediate pressure rectification column 82, and the bottom of a further rectification column 84 for producing argon and oxygen products. That part of the nitrogen condensed in the condenser-reboiler 76 which is not required as reflux in the higher pressure rectification column 64 is sub-cooled in a heat exchanger 86, is passed through a throttling valve 88, is introduced through an inlet 90 into the top of the lower pressure rectification column 74, and provides liquid nitrogen reflux for that column.

A stream of oxygen-enriched liquid is withdrawn from the bottom of the higher pressure fractionation column 64 through an outlet 92, is sub-cooled in the heat exchanger 86, is reduced in pressure by passage through a throttling valve 94, and is introduced into the bottom of the intermediate pressure rectification column 82. The intermediate pressure rectification column 82 is also fed with one of the two parts of the cooled second subsidiary air stream that are not sent to the higher pressure fractionation column 64. This part is reduced in pressure by passage through a throttling valve 96 upstream of its introduction in liquid state into the intermediate pressure rectification column 82 through an inlet 98. The intermediate rectification column 82 separates the air into firstly liquid air further enriched in oxygen and secondly nitrogen. The column 82 is provided with liquid-vapor contact devices (not shown) such as trays or structured packing to enable an ascending vapor phase to come into intimate contact with a descending liquid phase, thereby enabling mass transfer to take place between the two phases. The upward flow of vapor is created by boiling the liquid that collects at the bottom of the intermediate rectification column 82. This boiling is carried out in the boiling passages (not shown) of the condenser-reboiler 78, by indirect heat exchange with condensing nitrogen. A sufficient number of trays or a sufficient height of packing is included in the intermediate pressure column 82 to ensure that essentially pure nitrogen is produced at its top. A stream of this nitrogen vapor is withdrawn from the top of the intermediate pressure rectification column 82 and is condensed in a condenser 100. One part of the condensate is used as liquid nitrogen reflux in the intermediate pressure rectification column 82. Another part is pressurized by a pump 102 and is passed through the main heat exchanger 56 from its cold end 60 to its warm end 58. The pressurized nitrogen stream is thus vaporized and emerges from the warm end 58 of the main heat exchanger 56 as a high pressure nitrogen product at approximately ambient temperature. A third part of the nitrogen condensed in the condenser 100 is reduced in pressure by passage through a throttling valve 104, and is introduced into the top of the lower pressure rectification column 74 as reflux through an inlet 106. It will be appreciated, therefore, that operation of the intermediate pressure rectification column 82 enhances the rate at which nitrogen separated in the higher pressure fractionation column 64 can be condensed, and enhances the rate at which liquid nitrogen reflux can be provided to the columns 64 and 74.

A stream of liquid air further enriched in oxygen (typically containing about 40% by volume of oxygen) is withdrawn through an outlet 108 from the bottom of the intermediate pressure rectification column 82. The stream is divided into two parts. One part flows through a throttling valve 110 in order to reduce its pressure to a little above that at which the lower pressure rectification column 74 operates. The pressure reduced stream of further enriched liquid air flows through the condenser 100 in indirect heat exchange relationship with condensing nitrogen. Cooling is thus provided for the condenser 100 and the further-enriched liquid air is reboiled by the heat exchange. The resulting vaporized further enriched air stream is introduced through an inlet 112 into the lower pressure rectification column 74 at an intermediate liquid vapor contact region thereof. The other part of the further-enriched liquid air stream that is withdrawn from the bottom of the intermediate pressure rectification column 82 is divided again into two streams. One of these streams is reduced in pressure by passage through a throttling valve 114 and is introduced into the lower pressure rectification column 74 through an inlet 116 at a level above that of the inlet 112. The other stream of further enriched liquid air flows through a throttling valve 118 in order to reduce its pressure. The pressure-reduced further-enriched liquid air stream flows from the valve 118 through a condenser 120 which is associated with the head of the further rectification column 84. (The column 84 is located by the side of and fed from the lower pressure rectification column 74.) The stream of further-enriched liquid air flowing through the condenser 120 is reboiled and the resulting vapor is introduced into the lower pressure rectification column 74 through an inlet 122 at the same level as the inlet 112.

Further air feed streams for the lower pressure rectification column 74 are provided. First, the third part of the cooled second subsidiary air stream is taken from downstream of the cold end 60 of the main heat exchanger 56, is sub-cooled by passage through the heat exchanger 86, is passed through a throttling valve 124, and is introduced into the lower pressure rectification column 74 as a liquid stream through an inlet 126 at a level above that of the inlet 116 but below that of the inlets 90 and 106. Second, the third subsidiary purified air stream is employed as a feed to the lower pressure rectification column 74. This stream is further compressed in a compressor 128, cooled to a temperature of about 150K by passage through the main heat exchanger 56 from its warm end 58 to an intermediate region thereof, is withdrawn from the intermediate region of the main heat exchanger 56, is expanded to a pressure a little above that of the lower pressure rectification column 74 in an expansion turbine 130, and is introduced into the column 74 through an inlet 132 at the same level as the inlet 116. Expansion of the third subsidiary air stream in the turbine 130 takes place with the performance of external work which may, for example, be the driving of the compressor 128. Accordingly, if desired, the rotor (not shown) of the turbine 130 may be mounted on the same drive shaft as the rotor (not shown) of the compressor 128. Operation of the turbine 130 generates the necessary refrigeration for the air separation process. The amount of refrigeration required depends on the proportion of the incoming air that is separated into liquid product. In the plant shown in the drawing, only argon is produced in liquid state. Accordingly, only one turbine is required.

The various air streams fed to the lower pressure rectification column 74 are separated therein into oxygen and nitrogen products. In order to effect the separation, liquid-vapor contact devices (not shown), for example distillation trays or random or structured packing, are provided in the column 74 to effect intimate contact between ascending vapor and descending liquid therein, thereby enabling mass transfer to take place between the two phases. The downward flow of liquid is created by the introduction of liquid nitrogen reflux into the column 74 through the inlets 106 and 90. Indirect heat exchange of liquid at the bottom of the column 74 with condensing air in the condenser-reboiler 62 provides an upward flow of vapor in the column 74. This upward flow is augmented by operation of the condenser-reboiler 76 which reboils liquid withdrawn from mass exchange relationship with vapor at an intermediate level of the column 74, typically below that of the inlets 112 and 122. An essentially pure nitrogen product is withdrawn from the top of the lower pressure rectification column 74 through an outlet 133, is warmed by passage through the heat exchanger 86 countercurrently to the streams being sub-cooled therein, and is further warmed by passage through the main heat exchanger 56 from its cold end 60 to its warm end 58. A pure nitrogen product at a relatively low pressure is thus able to be produced at approximately ambient temperature.

A relatively pure oxygen product (typically containing 99.5% oxygen) is withdrawn in liquid state through an outlet 134 at the bottom of the column 74 and is pressurized by a pump 136 to a desired elevated supply pressure. The resulting pressurized liquid oxygen stream is vaporized by passage through the heat exchanger 56 from its cold end 60 to its warm end 58.

Although the incoming air contains only about 0.93% by volume of argon, a higher peak argon concentration is created at an intermediate region of the lower pressure rectification column 74. The column 74 is thus able to act as a source of argon-enriched oxygen for separation in the further rectification column 84. An argon-enriched oxygen stream in liquid state is taken from an intermediate liquid-vapor contact region of the low pressure rectification column 74 where the argon concentration is about 7% by volume (and only traces of nitrogen are present). The liquid argon-enriched oxygen stream is withdrawn from the column 74 through an outlet 138, is reduced in pressure by passage through a throttling valve 140 and is introduced into an intermediate region of the further rectification column 84 through an inlet 142. The further rectification column 84 contains a low pressure drop packing (preferably structured packing) (not shown) to enable ascending vapor to come into intimate contact with descending liquid. Packing is provided in the column both below and above the level of the inlet 142. The descending flow of liquid above the level of the inlet 142 is created by condensation in the condenser 120 of vapor taken from the head of the further rectification column 84. A part only of the condensate provides the reflux for the further column 84; the remainder of the condensate is taken as argon product through an outlet 144. The upward flow of vapor through the rectification column 84 is created by reboiling of liquid collecting at the bottom of the column 84. The reboiling is performed in the condenser-reboiler 80 by indirect heat exchange with nitrogen separated in the higher pressure fractionation column 64. A stream of such nitrogen is supplied via a throttling valve 146 to the condensing passage of the condenser-reboiler 80, is condensed therein and is returned as reflux to the higher pressure rectification column 64 by a pump 148.

An impure oxygen product typically containing 98.5% by volume of oxygen is withdrawn from the bottom of the further rectification column 84 through an outlet 150 by a pump 152 which raises the oxygen to a supply pressure. The resulting impure oxygen product is vaporized by passage through the main heat exchanger 56 from its cold end 60 to its warm end 58. The pressure at which the second subsidiary purified air stream is passed through the main heat exchanger 56 is selected so as to maintain a close match between the temperature-enthalpy profile of this stream and that of the vaporizing liquid oxygen streams.

In a typical example of the operation of the plant shown in FIG. 2 of the drawings, the higher pressure fractionation column 64 operates at a pressure in the range of 3.75 to 4.5 bar at its top; the intermediate pressure rectification column 82 at a pressure in the range of 2.4 to 2.8 bar at its top; the lower pressure rectification column 74 at a pressure of about 1.3 bar at its top; and the argon rectification column 84 at a pressure of about 1.05 bar at its top. The impure and pure oxygen products are typically produced in this example at a pressure of 8 bar and the pressurized nitrogen product at a pressure of 10 bar. Further, in this example, the compressor 68 has an outlet pressure of 24 bar and the compressor 128 an outlet pressure of 7 bar. By virtue of the operation of the intermediate pressure rectification column 82, it is possible in this example to recover up to 50% of the argon in the incoming air as an argon product and to produce up to 35% of the oxygen product at a purity of 99.5%.

Although the argon recovery of the plant shown in FIG. 2 is not limited by conditions in the top section of the lower pressure rectification column 74, a limitation would nonetheless appear at a maximum argon condensation duty in the condenser 120. If further enriched liquid is vaporized at too high a rate in the condenser 120, a pinch in the lower pressure rectification column occurs at the point where this vapor is introduced into it.

Figure 3:
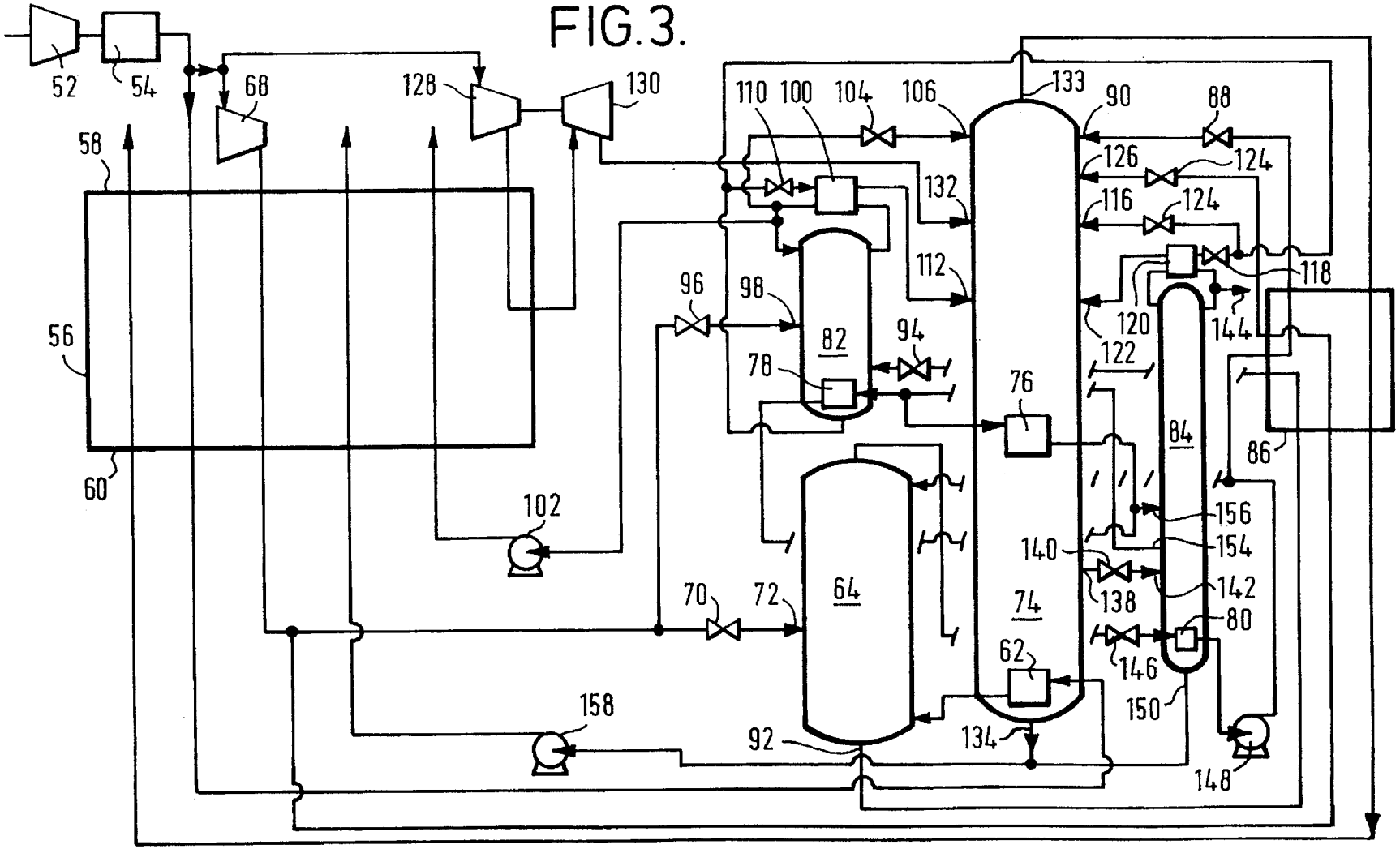
FIG. 3 is a schematic flow diagram of a second air separation plant for performing the method according to the invention.

The air separation plant shown in FIG. 3 enables all the oxygen product to be produced at relatively high purity and a high argon recovery to be obtained. This result is achieved by employing the condenser-reboiler 80 to meet the entire condensation duty of the higher pressure fractionation column 64 and uses an alternative means of heating the condenser-reboilers 76 and 78.

Like parts in FIGS. 2 and 3 are identified by the same reference numerals. Referring to FIG. 3, the condenser-reboilers 76 and 78 are heated by passing through their respective reboiling passages streams of argon-enriched oxygen vapor withdrawn from the further rectification column through an outlet 154 located at a level just above that of the inlet 142. The argon-enriched vapor is condensed and is returned to an intermediate mass transfer region of the further rectification column 84 through an inlet 156 situated above the outlet 154. Since the condenser-reboiler 80 now meets the entire condensation duty of the higher pressure fractionation column 64, a relatively pure (99.5%) oxygen product is able to withdrawn in liquid state from the bottom of the further rectification column 64 through the outlet 150. This product is combined with that withdrawn through the outlet 134 and is pressurized by a single pump 158 which takes the place of the pumps 136 and 152 of the plant shown in FIG. 2. In other respects the plant shown in FIG. 3 and its operation are analogous to the plant shown in FIG. 2.

It is possible by operation of the plant shown in FIG. 3 to achieve an argon recovery of about 80% with an oxygen recovery of 97%. If no pressurized nitrogen product is required (or if it is formed from the nitrogen product withdrawn from the lower pressure rectification column an argon recovery of over 90% and an oxygen recovery of over 99% are achievable. In addition, in comparison with a comparable conventional plant, the total power consumption is less in operation of the plant shown in FIG. 3 since its higher pressure fractionation column 64 is able to operate at a lower pressure than the corresponding column of a conventional double rectification column for the separation of air.

I claim:

1. A method of separating argon from air comprising: introducing a flow of compressed and cooled feed air in at least partly vapor state into a higher pressure rectifier and separating the flow into oxygen-enriched liquid air and nitrogen; condensing the nitrogen so separated and employing one part of the condensate as reflux in the higher pressure rectifier and another part of it as reflux in a lower pressure rectifier; separating in the lower pressure rectifier a stream of oxygen-enriched liquid air derived directly or indirectly from the higher pressure rectifier; reboiling the lower pressure rectifier with a vapor stream of the feed air; withdrawing a stream of argon-enriched liquid oxygen from the lower pressure rectifier and separating it by rectification in a further rectifier to produce an argon product; at least part of the said nitrogen being condensed by being employed to reboil the further rectifier.

2. The method as claimed in claim 1, in which the lower pressure rectifier is reboiled at an intermediate level in addition to its being reboiled by the said stream of feed air.

3. The method as claimed in claim 1, in which the argon-enriched liquid oxygen stream is reduced in pressure upstream of its introduction to the further rectifier; and liquid-vapor contact devices are employed below as well as above the level at which the argon-enriched liquid feed is introduced into the further rectifier, whereby separation takes place within the further rectifier both above and below said level.

4. The method as claimed in claim 3, in which the stream of oxygen-enriched liquid is introduced into an intermediate pressure rectifier in which nitrogen-enriched vapor is separated therefrom, and a liquid air stream further enriched in oxygen is withdrawn from the intermediate pressure rectifier and fed to the lower pressure rectifier.

5. The method as claimed in claim 4, wherein a part of the stream of liquid air further enriched in oxygen which is fed to the lower pressure rectifier is employed to condense argon separated in the further rectifier, and a part of the resulting argon condensate is returned to the further rectifier as reflux, and another part is taken as product; another stream of liquid air further enriched in oxygen is withdrawn from the bottom of the intermediate pressure rectifier, is reduced in pressure, and is employed to condense nitrogen-enriched vapor separated in the intermediate pressure rectifier by indirect heat exchange therewith; and the other stream of liquid air is reboiled by its heat exchange with the nitrogen-enriched vapor, and the resulting reboiled stream of further-enriched air is introduced into the lower pressure rectifier.

6. The method as claimed in claim 4, in which the lower pressure rectifier is reboiled at said intermediate level by nitrogen separated in the higher pressure rectifier, the said nitrogen thereby being condensed.

7. The method as claimed in claim 6, in which nitrogen separated in the higher pressure rectifier is employed to reboil the intermediate pressure rectifier, the said nitrogen thereby being condensed.

8. The method as claimed in claim 4, in which a relatively impure oxygen product is withdrawn from the bottom of the further rectifier and a relatively pure oxygen product is withdrawn from the bottom of the lower pressure rectifier.

9. The method as claimed in claim 4, in which the lower pressure rectifier is reboiled at said intermediate level by a vapor stream withdrawn from an intermediate region of the further rectifier.

10. The method as claimed in claim 9, in which the vapor stream withdrawn from the intermediate region of the further rectifier is at least partially condensed as a result of its being used to reboil the lower pressure rectifier at said intermediate level, and the resulting condensate is returned to the further rectifier; another vapor stream withdrawn from the said intermediate region of the further rectifier is employed to reboil the intermediate rectifier; the other vapor stream is condensed as a result of its being used to reboil the intermediate rectifier and the resulting condensate is returned to the further rectifier.

11. The method as claimed in claim 9, in which the whole of the nitrogen condensation duty of the higher pressure rectifier is met in effecting the reboiling of the further rectifier.

12. The method as claimed in claim 9, in which an oxygen product of at least 99% purity is separated in and withdrawn from the further rectifier.

13. The method as claimed in claim 9, in which all the oxygen product of the method according to the invention has a purity level of at least 99% (by volume).

14. An apparatus for separating air comprising:

a higher pressure rectifier for separating compressed and cooled feed air into oxygen-enriched liquid air and nitrogen; at least one condenser for condensing the nitrogen so separated so as to enable in use part of the condensed nitrogen to be employed in the higher pressure rectifier as reflux and another part of it in a lower pressure rectifier also as reflux; means for taking oxygen-enriched liquid air from the higher pressure column and for introducing it directly or via a further separating means into the lower pressure rectifier for separation therein; a reboiler associated pressure rectifier having condensing passages in communication with a source of compressed and cooled feed air in vapor state; and a further rectifier for producing an argon product having an inlet for an argon-enriched liquid oxygen stream communicating with an outlet from the lower pressure rectifier, the at least one condenser acting as a reboiler for the further rectifier.

15. The apparatus as claimed in claim 14, in which the lower pressure rectifier has in addition to said reboiler a further reboiler associated with an intermediate level thereof.

16. The apparatus as claimed in claim 15, in which the inlet for the argon-enriched liquid oxygen stream communicates with the outlet from the lower pressure rectifier via a throttling valve and there are liquid-vapor contact devices in the lower pressure rectification column both above and below the level of said inlet for the argon-enriched liquid oxygen stream.

17. The apparatus as claimed in claim 16, wherein said further separation means comprises an intermediate pressure rectifier, said intermediate pressure rectifier having an outlet for liquid air further enriched in oxygen communicating with the lower pressure rectifier.

18. The apparatus as claimed in claim 16, in which there is an outlet for oxygen product at the bottom of the further rectifier.

* * * * *